US006698724B1

(12) United States Patent
Traeger et al.

(10) Patent No.: US 6,698,724 B1
(45) Date of Patent: Mar. 2, 2004

(54) POST SETTING METHOD

(76) Inventors: Joseph P. Traeger, 255 Alder St., Mt. Angel, OR (US) 97362; Mark A. Traeger, 260 S. Oak, Mt. Angel, OR (US) 97362; Randolph J. Traeger, 530 Alder St., Mt. Angel, OR (US) 97362

( * ) Notice: Subject to any disclaimer, the term of this patent is extended or adjusted under 35 U.S.C. 154(b) by 0 days.

(21) Appl. No.: 09/620,830

(22) Filed: Jul. 21, 2000

Related U.S. Application Data

(60) Provisional application No. 60/148,405, filed on Aug. 11, 1999.

(51) Int. Cl.[7] ..... E04H 17/22; E04H 17/00

(52) U.S. Cl. ..... 256/1; 52/741.1; 47/64

(58) Field of Search ..... 47/58.1 R, 63, 47/64, 44; 256/1, 65; 52/741.1, 741.11, 742.1, 742.11, 742.13, 745.17

(56) References Cited

U.S. PATENT DOCUMENTS

| | | | | | |
|---|---|---|---|---|---|
| 2,815,780 | A | * | 12/1957 | O'Higgins | 144/362 |
| 3,973,355 | A | | 8/1976 | McKenzie | |
| 4,268,994 | A | * | 5/1981 | Urai | |
| 4,473,390 | A | * | 9/1984 | Teufel | 71/23 |
| 4,881,342 | A | * | 11/1989 | Ferguson | 47/47 |
| 4,936,386 | A | | 6/1990 | Colangelo | |
| 5,082,563 | A | | 1/1992 | Webb et al. | |
| 5,288,439 | A | | 2/1994 | Babcock et al. | |
| 5,542,209 | A | * | 8/1996 | Sheu | 47/44 |
| 5,653,053 | A | * | 8/1997 | Handley | 47/58.1 X |
| 6,397,520 | B1 | * | 6/2002 | Kosinski | 47/64 |

FOREIGN PATENT DOCUMENTS

| | | | |
|---|---|---|---|
| CA | 2314640 | * | 2/2001 |
| DE | 3210186 A1 | * | 9/1983 |
| DE | 29705647 U1 | * | 5/1997 |
| GB | 1155327 | * | 6/1969 |
| WO | WO 99/31963 | * | 7/1999 |

OTHER PUBLICATIONS

University of Arkansas, Growing media for container production in a greenhouse or Nusery, 1999, pp. 2–3.*

* cited by examiner

*Primary Examiner*—Peter M. Poon
*Assistant Examiner*—Jeffrey L. Gellner
(74) *Attorney, Agent, or Firm*—Kolisch Hartwell, P.C.

(57) ABSTRACT

A method of setting a pole in the ground. A cavity is prepared in the ground extending down from ground level. The pole has an end placed in the cavity. Organic fiber pellet material, expansible with the addition of water thereto, is introduced to the cavity and the cavity filled. Water is then added to produce a porous organic cake firmly holding the post in place.

6 Claims, 1 Drawing Sheet

POST SETTING METHOD

CROSS-REFERENCE TO RELATED APPLICATION

This application claims priority from U.S. Provisional Patent Application Serial No. 60/148,405, filed Aug. 11, 1999, which is hereby incorporated by reference.

BACKGROUND OF THE INVENTION

This invention relates to what is referred to herein as a post setting method. The term "post" as used herein is used in its broadest sense, with the term embracing any of a number of different elongate objects advantageously set in a position extending upright from a suitable support.

The invention herein described embraces the method of seating the end of an elongate object to establish an upright position for the object. The end of the object is placed within the confines of a cavity. A space is established about the object end, or at least to one side of the end of the object, and this space is filled with an organic pellet material which expands with the introduction of water. With the pellet material introduced to the space and then water added to the pellets, the pellets expand to produce a porous cake firmly holding the end of the object in place.

SUMMARY OF THE INVENTION

In the preferred embodiment of the invention herein described, the pellet material is exemplified by wood pellets normally produced with a pressure extrusion process and manufactured from wood residues. The pellets are available as a fuel in the United States. The pellets are composed of lignocellulose, and are referred to herein as pellets of organic fiber material. While conveniently made from wood, other forms of lignocellulose or like material can be used, such as corn husks, bagasse and other organic fiber residues. The pellet material described with water introduced thereto expands, with an expansion of from 50 to 100% of the original volume of the pellets being typical. A water pervious cake is produced which firmly holds the end of the object in a seated position.

The invention contemplated may be employed in the setting of fence posts. It is also advantageous used in the mounting of rooting plant segments in an upright position in the ground where the biodegradable porous cake which is formed with pellet expansion is ideally suited for holding the plant segment while propagation through root formation occurs. Further illustrating a use of the invention is the mounting of a Christmas tree in a portable canister or container.

Various objects and advantages are attained by the invention, which is described hereinbelow in conjunction with the accompanying drawings, wherein:

DETAILED DESCRIPTION OF THE PREFERRED EMBODIMENT

As earlier discussed, wood pellets produced by compacting and extruding wood residue such as hog fuel, sawdust, etc. under heat and pressure are distributed commercially as a fuel source within this country, and pellets of this description are well suited for the practice of the invention. These pellets made of compacted or compressed lignocellulose material, broadly referred to as an organic fiber material, might typically be prepared with pressures of 1500 to 2500 pounds per square inch, and with temperatures ranging from 300° to 450° Fahrenheit. A typical pellet formed as a fuel pellet may have approximately from ⅛ to ⅜ inch diameter, and lengths ranging from ¼ to ¾ of an inch. This is of a size which renders them easily introduced into a space with a pouring of the pellets into the space.

A typical wood pellet of the above description, with the introduction of water, may expand from 50 to 100% of its original size. The expansion is permanent, which is to say that subsequent drying of the material will not have the effect of causing such to shrink to reestablish its original shape. When expanded by the introduction of water, a water permeable or porous cake is formed, which holds firmly any object enveloped by the original pellet material.

The material described, since it is porous, is well suited as a packing material for holding a rooting plant segment. The material is biodegradable, in the sense that unlike concrete, for instance, the material over a period of time gradually decomposes to form part of the terrain. An advantage of practicing the invention over using concrete, for instance, is that any cake that is produced, while firmly holding a post, can be relatively easily removed or replaced in the event, for instance, that it is desired to replace the fence post with a new one.

Figure 1:
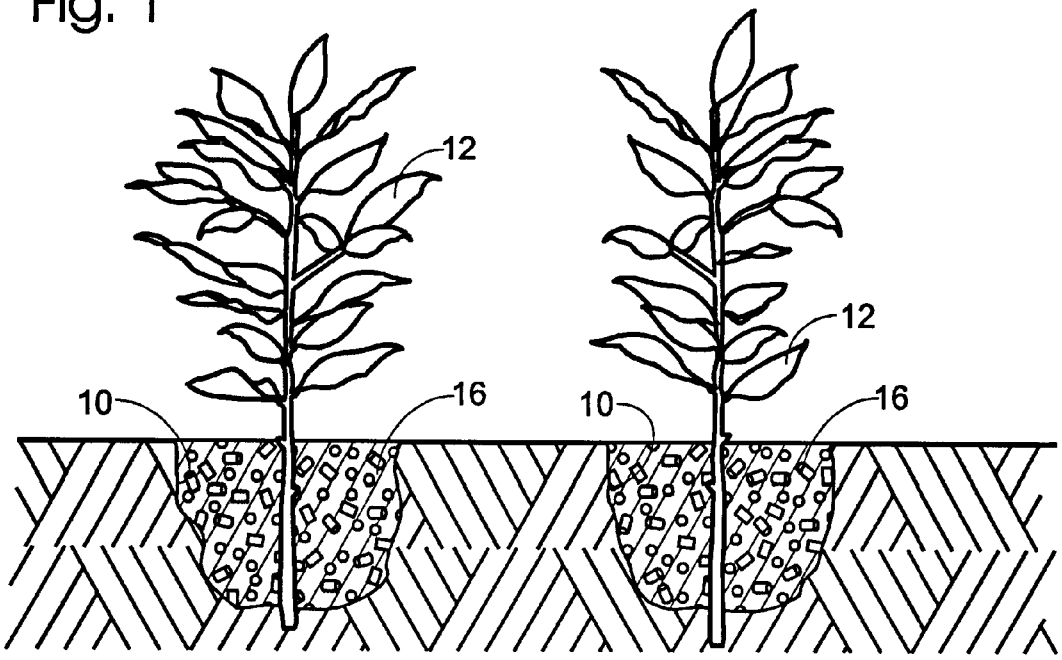
FIG. 1 illustrates, in a simplified manner, the use of the invention in the mounting of rooting plant segments in the ground.

Referring now to the drawings, and initially to FIG. 1, illustrated in this figure is the invention as such is practiced in the propagation of a tree from a rooting segment of the tree. By way of example, a segment of a tree, such as a poplar branch, can be used in a propagation method to produce a rooted sapling by placing the end of the poplar segment in the ground and then with water and appropriate chemicals inducing root growth in the buried portion of the plant segment.

As illustrated in FIG. 1, the ground is prepared for the planting of poplar segments by first producing small excavations in the ground, to produce cavities 10 which extend downwardly into the ground from ground level.

Rooting plant segments, exemplified by the poplar segments shown at 12, are then placed in an upright position with their bottom ends in these cavities. If desired, the ends may be pressed slightly downwardly into the base of the cavity as illustrated. Alternatively, the segment ends merely may be rested on the bottoms of the cavities. The cavities have such a size that with the segments 12 so positioned, a space is left which extends about the bottom ends of the plant segments. With the segment so positioned, pellet material is introduced into these spaces 14. Normally sufficient pellet material is introduced to completely fill or essentially fill the cavities 10. It may be desirable in the planning of poplar segments to introduce with the pellet material a small amount of rooting or growth promoting material.

With the pellet material introduced to fill the cavities, water is then introduced to the cavities to mix with the pellet material. The pellets absorb water relatively rapidly, which is to say that within only a few minutes there is swelling and disintegration of the pellets sufficient to produce a readily discernible firming of the set position of the plant segments. Within an hour, a firm cake is produced from the pellets, illustrated in the drawings at 16, which is porous. The cake will accept water, but has a firm stabilized condition, which firmly holds the plant segments in their upright position.

During a dry season such as during the summer months, the cake produced may lose most, if not all of its water. Nevertheless, it still retains an expanded condition, sufficient to firmly hold a plant segment in an upright position.

The invention contemplated may be utilized in the support of a portable object, such as a Christmas tree.

Figure 2:
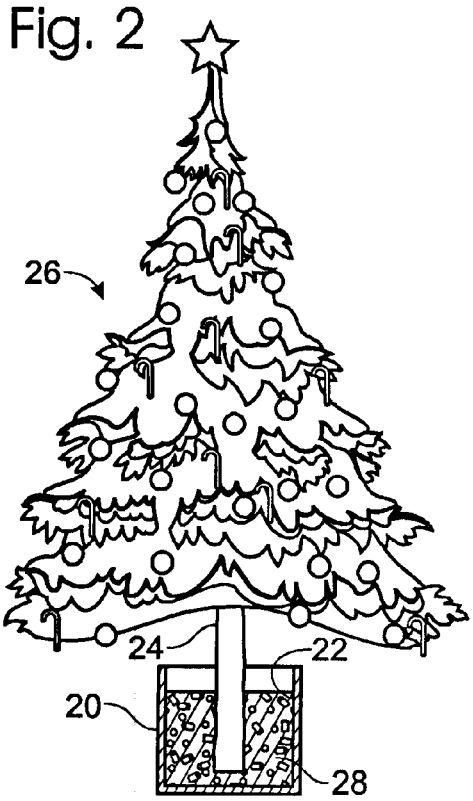
FIG. 2 illustrates the invention as such may be employed in the mounting of the end of a Christmas tree.

Referring now to FIG. 2, designated at 20 is an open top container, having a hollow interior 22. The bottom end of the trunk 24 of a tree 26 is placed within the interior of container 20. Again, a space is provided about the exterior of the trunk and inwardly of the container's sides. This space is filled with pellet material. After filling with the pellets, the fill is saturated with water. This causes the pellets to swell to produce a cake 28 embracing and firmly holding the bottom of the tree trunk. A tree so mounted can be moved about from place to place if desired. To inhibit flammability in the tree, the cake may be maintained in its moist state by replenishing water as such evaporates. Moist or dry, the cake firmly holds the tree trunk in place.

Figure 3:
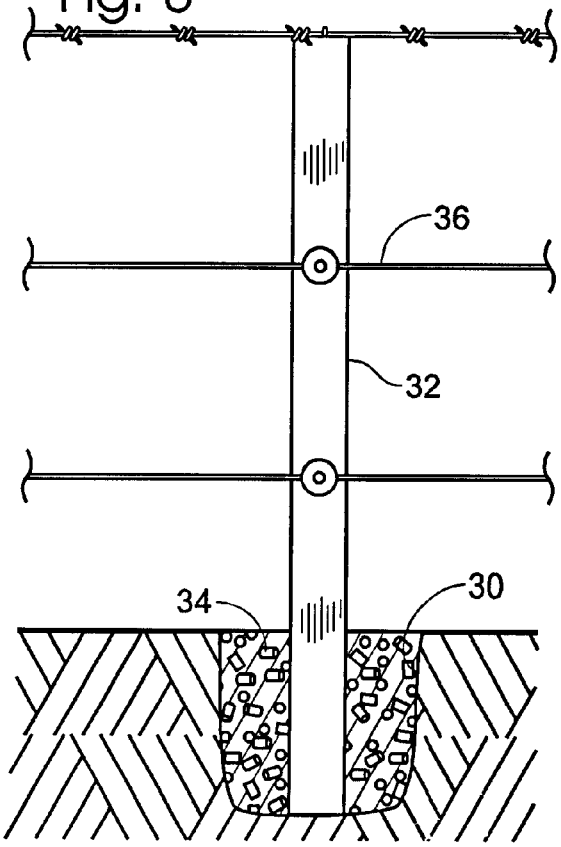
FIG. 3 illustrates the invention as such is employed in the mounting of fence posts.

The invention may also be employed in setting posts, such as fence posts in a field. Referring to FIG. 3, cavities 30 are prepared in the ground. Posts 32 have their bottom ends placed in these cavities. The space about the posts bounded by the sides of the cavities is filled with pellets. Water is then introduced to these pellets. This produces swelling of the pellets and the production of a cake 34 in each cavity surrounding the bottom end of a post and holding it firmly. The post is held securely in both dry and wet conditions. The posts may be used in the stringing of fence wire, shown at 36.

It should be obvious from the above that the method of the invention has a number of advantages. Following the invention, posts and other elongate objects are readily set in a upright position in the field. Adding moisture to the pellets rapidly converts them to a dense cake permanently holding an object, without tamping, in the upright position desired.

Variations and modifications of the invention are possible without departing from the invention.

We claim:

1. A method of seating the end of a post comprising:

providing a cavity for receiving the end of the post, placing the end of the post within the cavity and establishing a space within the cavity disposed to one side of the post, introducing a water expansible, organic fiber, pellet material to said space to produce a fill, and introducing water to said fill to cause expansion and consolidation of the pellet material into a water pervious cake that is capable of firmly holding the end of the post without tamping.

2. The method of claim 1, wherein the cavity is prepared extending downwardly in the ground from ground level, and the pellet material is introduced to at least partially fill the cavity below ground level.

3. The method of claim 2, wherein the elongate object is a fence post.

4. The method of claim 1, wherein the pellet material comprises lignocellulose.

5. The method of claim 1, wherein the step of introducing water to said fill causes a 50%–100% expansion of the pellet material.

6. The method of claim 1, wherein the pellet material has a diameter of approximately ⅛–⅜ inch and a length of approximately ¼–¾ inch.

* * * * *